US010959509B1

(12) United States Patent
Conner

(10) Patent No.: US 10,959,509 B1
(45) Date of Patent: Mar. 30, 2021

(54) REUSEABLE STRAW WASH TOOL ASSEMBLY

(71) Applicant: George W. Conner, Monterey, CA (US)

(72) Inventor: George W. Conner, Monterey, CA (US)

( * ) Notice: Subject to any disclaimer, the term of this patent is extended or adjusted under 35 U.S.C. 154(b) by 0 days.

(21) Appl. No.: 16/949,662

(22) Filed: Nov. 9, 2020

Related U.S. Application Data

(63) Continuation-in-part of application No. 16/672,482, filed on Nov. 3, 2019, now Pat. No. 10,827,823.

(51) Int. Cl.

| | |
|---|---|
| ***A46B 9/02*** | (2006.01) |
| ***A47L 25/00*** | (2006.01) |
| ***B08B 9/027*** | (2006.01) |
| ***A46B 17/02*** | (2006.01) |
| ***B08B 9/023*** | (2006.01) |
| ***B08B 9/04*** | (2006.01) |
| ***A46B 17/00*** | (2006.01) |
| ***A46B 15/00*** | (2006.01) |

(52) U.S. Cl.
CPC ..... *A46B 9/02* (2013.01); *A46B 15/0097* (2013.01); *A46B 17/00* (2013.01); *A46B 17/02* (2013.01); *A47L 25/00* (2013.01); *B08B 9/023* (2013.01); *B08B 9/027* (2013.01); *B08B 9/04* (2013.01); *A46B 2200/3013* (2013.01); *A46B 2200/3073* (2013.01)

(58) Field of Classification Search
CPC .. A46B 9/00; A46B 9/02; A46B 9/026; A46B 9/028; A46B 15/0095; A46B 15/0097; A46B 17/00; A46B 17/02; A46B 17/08; A46B 2200/30; A46B 2200/3006; A46B 2200/3013; A46B 2200/3073; A47L 17/00; A47L 25/00; B08B 9/00; B08B 9/02; B08B 9/023; B08B 9/027; B08B 9/04
USPC ..... 15/88, 104.03, 14.04, 104.05, 104.16, 15/104.2, 104.92, 160, 164
See application file for complete search history.

(56) References Cited

U.S. PATENT DOCUMENTS 3,076,988 A * 2/1963 Mills ..... A01J 7/025 15/56
4,575,892 A * 3/1986 Ross ..... A46B 9/02 15/104.04

(Continued)

FOREIGN PATENT DOCUMENTS

JP 2000-279364 * 10/2000

*Primary Examiner* — Mark Spisich
(74) *Attorney, Agent, or Firm* — Charles I. Thoeming

(57) ABSTRACT

Embodiments of apparatus for reusable drinking straw cleaning include a flexible central brush and a plurality of external brushes supported by a hand-held handle. The flexible central brush is passed into one end of a drinking straw and the drinking straw is drawn down into concentrically disposed external brushes. The drinking straw is withdrawn, reversed and the process is repeated. A handle or central bore provides external brush pressure onto the straw when it has been drawn into contact with the external brushes. After both ends of the reusable drinking straw are cleaned, the reusable drinking straw is withdrawn from the assembly and placed in a sterilizing solution or dishwasher, and dried. The flexible central brush is replaced without disassembly of the apparatus. Embodiments provide a support stand to receive and hold the assembly in a vertical position from the bottom of a wash sink.

9 Claims, 16 Drawing Sheets

(56) References Cited

U.S. PATENT DOCUMENTS 5,564,149 A * 10/1996 Matesic ..... A46B 9/02
15/104.04
6,039,490 A * 3/2000 Banks ..... A46B 9/02
15/104.2

* cited by examiner

REUSEABLE STRAW WASH TOOL ASSEMBLY

CROSS-REFERENCES TO RELATED APPLICATIONS

This United States non-provisional patent application is a continuation-in-part of U.S. non-provisional patent application Ser. No. 16/672,482 filed Nov. 3, 2019.

STATEMENT REGARDING FEDERALLY SPONSORED RESEARCH OR DEVELOPMENT

None.

REFERENCE TO A MICRO-FICHE APPENDIX

None.

NOTICE REGARDING COPYRIGHTED MATERIAL

A portion of the disclosure of this patent document contains material subject to copyright protection and/or copyright registration. The copyright owner has no objection to the facsimile reproduction by anyone of the patent document or the patent disclosure as it appears in the file or records maintained by the United States Patent and Trademark Office, but the copyright owner otherwise reserves all copyright rights.

TECHNICAL FIELD

The present application generally relates to cleaning systems. It relates to an apparatus for washing and cleaning reusable drinking straws.

BACKGROUND OF THE INVENTION

In bars and restaurants, many people prefer to drink beverages or drinks using a straw. Similarly, many reusable drinking vessels are provided with drinking straws. Hence, the straw plays an active role in our daily life due to its high availability. Further, if the straw is a reusable straw, then a user or business needs to clean the straw before using it again. It is difficult to clean the straw if the straw is used for a drink sticky in nature. It would be a benefit, therefore, to have a drinking straw cleaning apparatus, system, and method that could be used to clean a fluid passageway or hollow cavity of a drinking straw and the exterior straw surface.

State and local ordinances to eliminate the use of disposable or plastic straws are proliferating to improve the environment. Bar and restaurant owners are using non-disposable drinking straws manufactured principally from metal alloys safe for human use, such as stainless steel. These non-disposable drinking straws are prone to bacteriological and moisture contamination which present a challenge to maintain an inventory of sanitary non-disposable drinking straws. Most establishments are forced to use a brush to clean the inside of a metal drinking straw, and then to scour the outside of the metal drinking straw with a cleaning pad, all within a wash sink with detergent and water, and then into a sterilizing solution.

Drinking straws cleaning brushes are available in the art, and mainly include longitudinally disposed bristles. These brushes, although designed for cleaning the inner surfaces of the straws, do not effectively clean around corner ends or the external surface of the straw.

Many other variations of drinking straws cleaning brushes are found proposed in the art, such as in U.S. design Pat. D360301 and D532978. However, they are directed towards the aesthetic appearance and focus on solely the inner surfaces of straws and fail to reach tight spots, corners, or external surface in the straws for effective cleaning.

U.S. Pat. No. 6,039,490, by Banks et al., discloses a cleaning system for cleaning reusable drinking straws. The reusable drinking straw cleaning system as disclosed in the patent includes a flexible, tubular brush structure having a tubular cavity formed between a closed insertion end and an open ended, threaded squeeze bulb reservoir connecting end, several cleaning solution dispensing orifices provided along the length of the flexible tubular brush structure and several multi-length bristles extending outward from the flexible tubular brush structure.

U.S. Pat. No. 5,699,578, by Dumler et al., discloses a straw cleaning device. The cleaning device according to the disclosure includes two twisted, wire-type sections. The cleaning coming with the application of care and cleaning agents, that the wire-type sections are twisted in such a way that at least one free loop or eye is formed.

Thus, in the light of the above-mentioned background art, there is a need for drinking straws cleaning apparatus that would overcome or at least ameliorate the problems associated with existing cleaning assemblies and systems.

The above information is presented as background information only to help the reader to understand the present invention. Applicant has made no determination and makes no assertion as to whether the above might apply as prior art regarding the foregoing disclosed and claimed apparatus for washing and cleaning reusable drinking straws.

There likewise is a need for an apparatus for washing and cleaning reusable drinking straws that effectively and economically cleans the inside and the outside surfaces of the reusable drinking straw simultaneously.

There likewise is a need for a hand-held apparatus for washing and cleaning reusable drinking straws that effectively and economically cleans the inside and the outside surfaces of the reusable drinking straw simultaneously and that is inexpensive to manufacture.

There is yet another need for a hand-held apparatus for washing and cleaning reusable drinking straws that effectively and economically cleans the inside and the outside surfaces of both straight and angled drinking straws.

There is a further need for an apparatus for washing and cleaning reusable drinking straws that effectively and economically cleans the inside and the outside surfaces of the reusable drinking straw and allows for quick and easy replacement of all cleaning brushes.

There is also is a need for an apparatus for washing and cleaning reusable drinking straws that effectively and economically cleans the inside and the outside surfaces of the reusable drinking straw using upright support stand attached to the bottom of a wash sink or any other suitable planar surface.

DISCLOSURE OF INVENTION

An embodiment of the apparatus for washing and cleaning reusable drinking straws includes a hand-held handle supporting a flexible internal brush and a plurality of external brushes surrounding the internal brush. The internal brush extends beyond the plurality external brush assembly through a guide element bore. The guide element keeps the external brushes properly aligned around the internal brush while guiding the reusable drinking straw to enter the assembled plurality of external brushes through the guide element bore. A longitudinal bore through top portion of the hand-held handle surrounds the assembled plurality of external brushes. The action of moving the hand-held handle back and forth along an inserted reusable straw provides contact with the external brushes and scours the curved ends and external surface of the reusable straw. Other embodiments provide a stand assembly to adapt the hand-held handle into an upright position from the bottom of a wash sink or any other suitable planar surface embodying the apparatus for washing and cleaning reusable drinking straws.

BRIEF DESCRIPTION OF DRAWINGS

These and other features, aspects, and advantages of the apparatus for washing and cleaning reusable drinking straws will become better understood regarding the following description, and drawings as further described.

BEST MODE FOR CARRYING OUT THE INVENTION

Embodiments of apparatus for washing and cleaning reusable drinking straws are disclosed generally in FIGS. 1-18.

Figure 1:
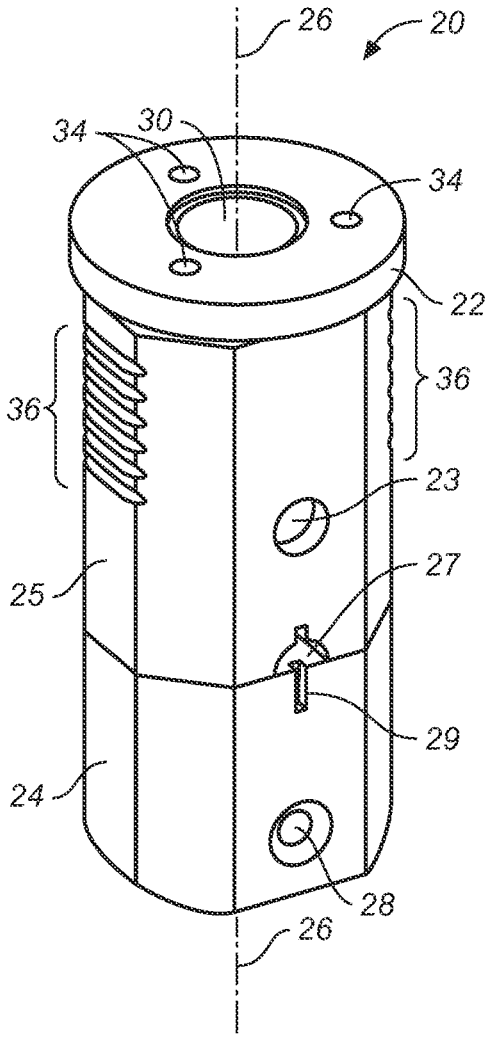
FIG. 1 is a distal end top perspective view of the handle element 20 for an embodiment of the hand-held apparatus 10 for washing and cleaning reusable drinking straws.
Figure 2A:
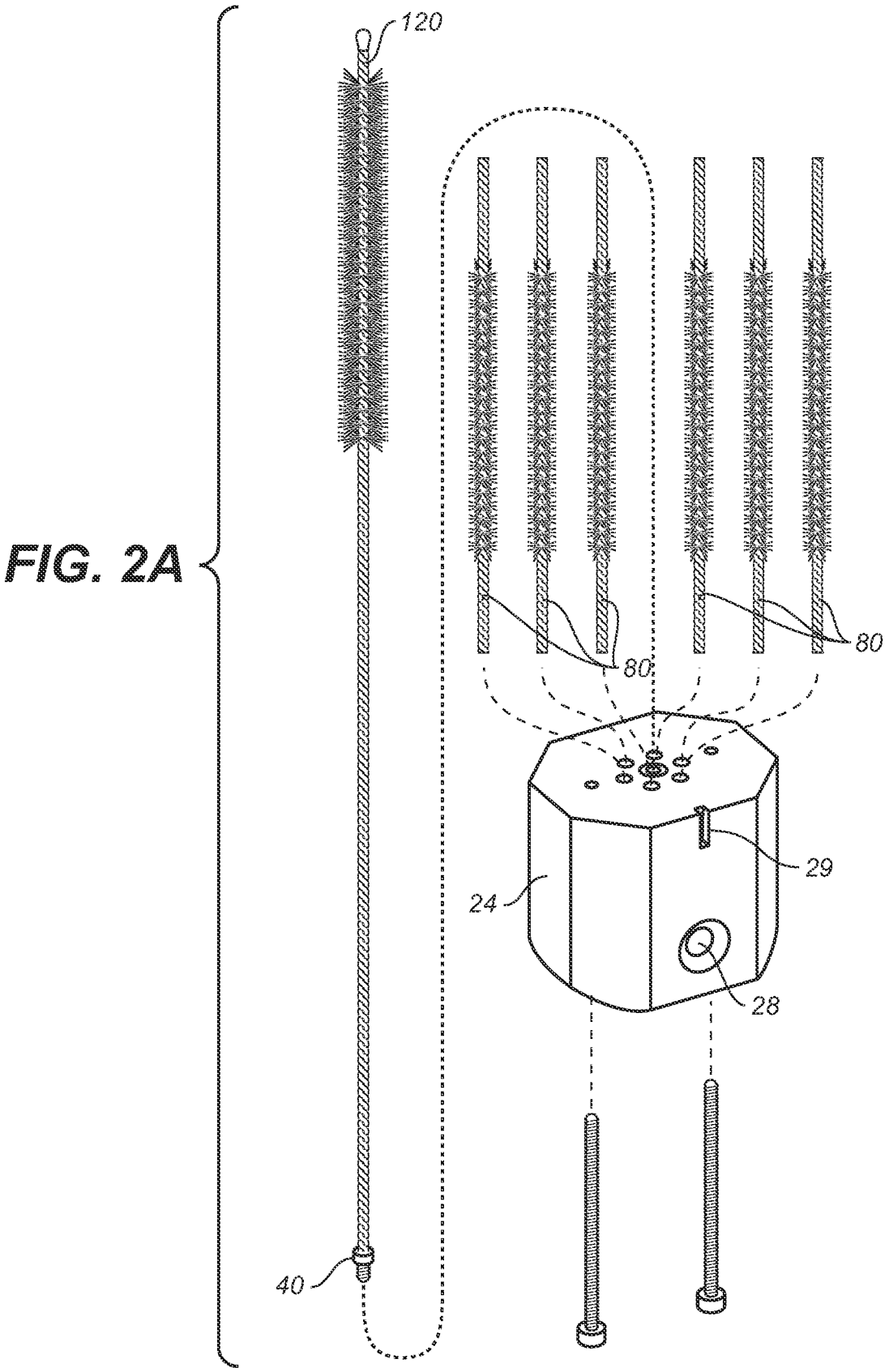
FIG. 2A is an exploded view of the brushing elements and the distal end top perspective view of the handle base element 24 for an embodiment of the hand-held apparatus 10 for washing and cleaning reusable drinking straws.

An embodiment of the hand-held reusable drinking straw wash tool assembly 10 includes a handle base element 24, FIGS. 1 and 2A. The handle base element 24 provides a distal end surface, FIG. 7, a proximal end surface, FIG. 8, and a longitudinal central axis 26. The handle base element includes at least four side surfaces. Seven openings are included on the base element distal end surface. Six of the openings are an array of concentrically equally spaced and equal sized openings 33 about the handle base element longitudinal central axis 26. The seventh opening 35 is threaded and centered on the handle base element longitudinal central axis 26. Two equal sized openings 19 are included on opposite sides of the array of the concentrically and equally spaced openings 33 about the longitudinal central axis 26 of the handle base distal end surface, FIG. 7. The two equal sized openings 19 extend through the entire base element providing access from the handle base element distal end surface to the handle base element proximal end surface, FIG. 8. A handle base element aperture 28 orthogonally disposed to the longitudinal central axis 26 is provided through the handle base element 24 and is accessible from opposing sides of the handle base element, FIGS. 1-2C.

An embodiment of the hand-held reusable drinking straw wash tool assembly 10 includes a notch 29 in a handle base element 24 side and distal end surface, FIGS. 1-2C and 7. This notch 29 provides access to the assist in separating the handle base element 24 from the handle top element 25 for cleaning and maintenance of the handle 20.

Figure 2B:
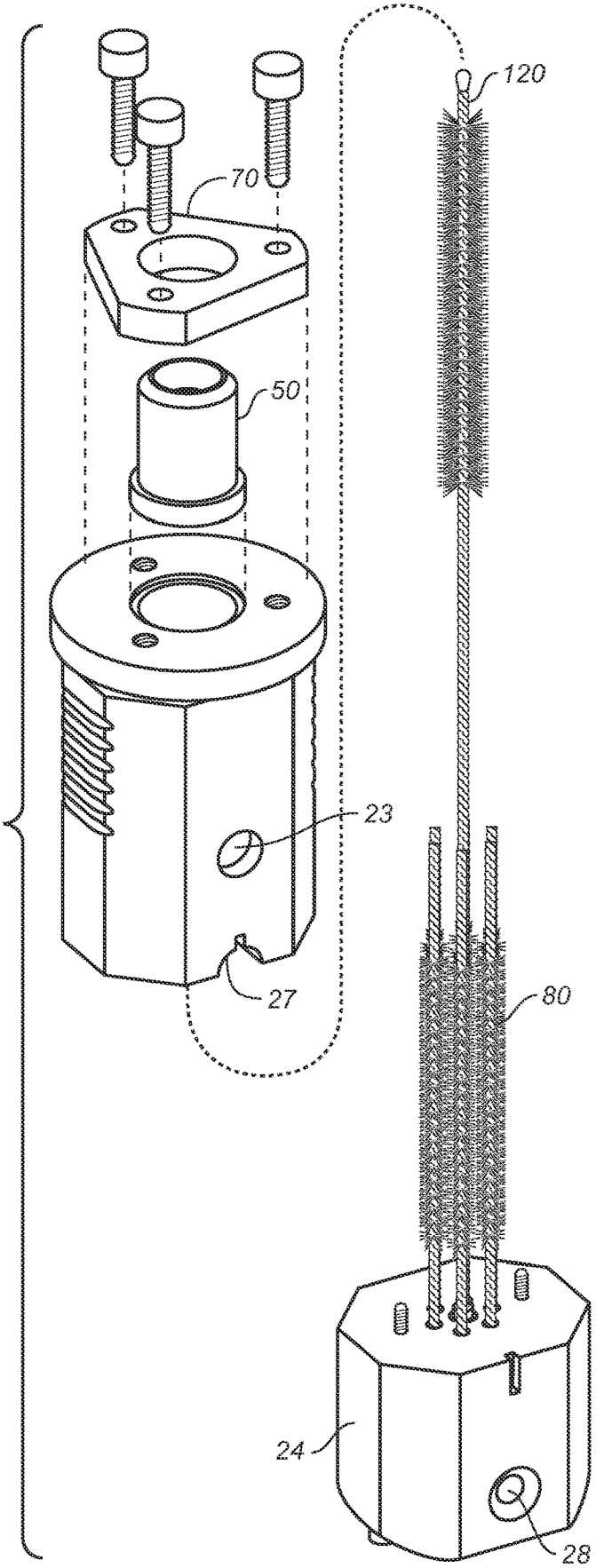
FIG. 2B is an exploded view of the distal end top perspective view of the of the handle top element 25, guide 50, and guide retainer 70 in relation to the handle base element and brushing elements of FIG. 2A for an embodiment of the hand-held apparatus 10 for washing and cleaning reusable drinking straws.
Figure 7:
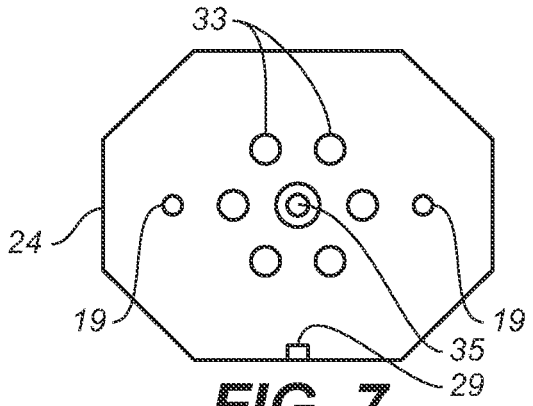
FIG. 7 is a planar view of the handle base element 24 distal surface.
Figure 8:
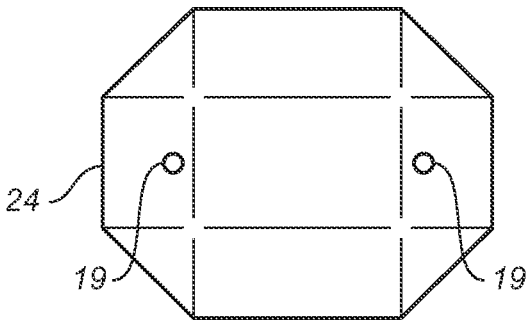
FIG. 8 is a planar view of the handle base element 24 proximal surface.
Figure 9:
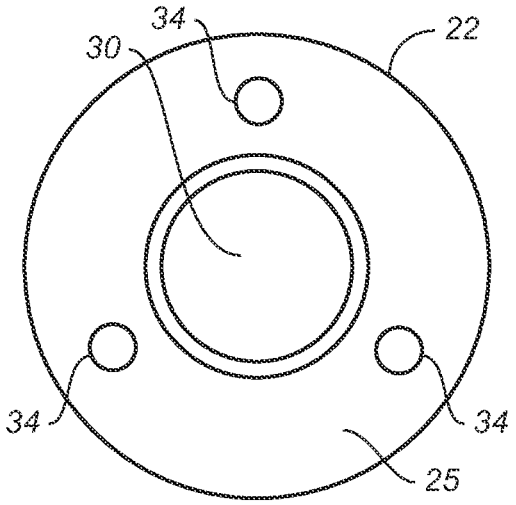
FIG. 9 is a planar view of the handle top element 25 distal surface.
Figure 10:
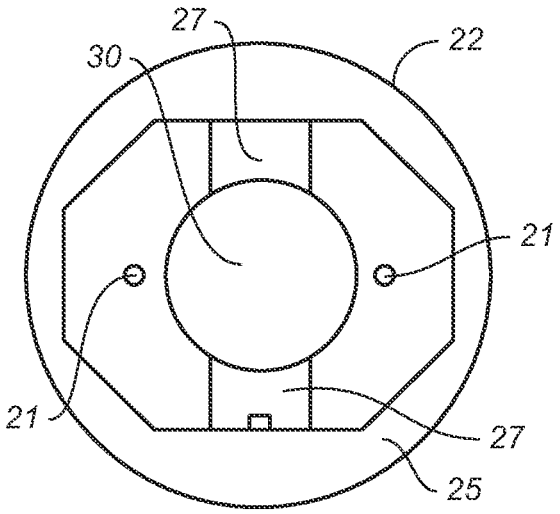
FIG. 10 is a planar view of the handle top element 25 proximal surface.

An embodiment of the reusable drinking straw wash tool assembly further includes a handle top element 25 providing a proximal end surface, FIG. 10, sized to correspond to the handle base element distal end surface, FIG. 7, a handle top element longitudinal central axis 26 corresponding to the longitudinal central axis 26 of the handle base element 24, and a flanged handle top element distal end surface 22, FIGS. 1 and 2B. The flanged handle top element distal end surface 22 includes three equal sized threaded openings 34 equally spaced about the handle top element longitudinal central axis 26, FIGS. 1, 2B, and 9. The handle top element 25 further includes at least four side surfaces sized to correspond to the handle base element 24 four side surfaces and provides ergonomic grip ridges 36 around the handle top element 25 side surfaces below the flanged handle top element distal end surface 22. A central bore 30, FIGS. 1, 9 and 10, having a diameter sized slightly less than the diameter of the array of concentrically and equally spaced openings in the handle base element 24 distal end surface, FIG. 7, through the entire handle top element along the longitudinal central axis provides access from the handle top element distal end surface, FIG. 9, to the handle top element proximal surface, FIGS. 1 and 10. Two equal sized threaded openings 21 are included on opposite sides of the central bore 30 on the handle top element proximal end surface, FIG. 10, sized and positioned to correspond to the two openings 19 on opposite sides of the array of the concentrically and equally spaced openings about the longitudinal central axis of the handle base distal end surface FIG. 7.

Figure 2C:
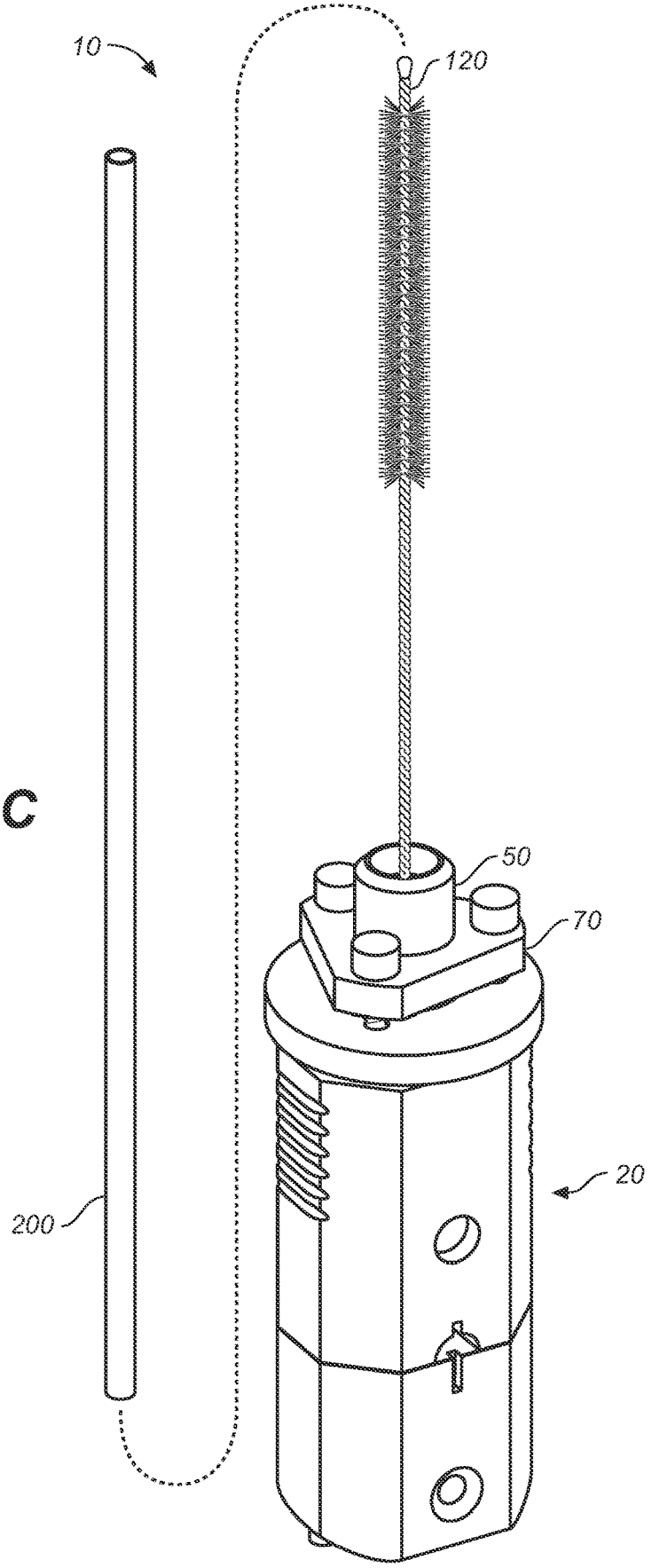
FIG. 2C is a distal end top perspective view of an embodiment of the hand-held apparatus 10 for washing and cleaning reusable drinking straws.

An embodiment of the hand-held reusable drinking straw wash tool assembly 10 further includes a handle top element aperture 23 orthogonally disposed to the longitudinal central axis 26 is provided through the handle top element 25 and is accessible from opposing sides of the handle top element, FIGS. 1-2C. This handle top element aperture 23 transects to the central bore 30 and allows fluid flow into and from the central bore 30 from either opposing handle top element side for cleaning solutions into the central bore 30 and to the concentrically and equally spaced external brushes 80 housed while cleaning a reusable straw. This handle top element aperture 23 also enhances air drying of the central bore 30 and the concentrically and equally spaced external brushes 80 while the assembly is not is use.

An embodiment of the hand-held reusable drinking straw wash tool assembly 10 includes a handle top element channel 27 orthogonally disposed to the longitudinal central axis 26. This top element channel 27 is provided through the handle top element proximal surface and is accessible from opposing sides of the handle top element, FIGS. 1-2C, and 10. This handle top element channel 27 transects the central bore 30 to allows fluid flow into and from from the central bore 30 from either opposing handle element side for cleaning solutions into the central bore 30 and to the concentrically and equally spaced external brushes 80 housed while cleaning a reusable straw. This handle top element channel 27 also enhances air drying of the central bore 30 and the concentrically and equally spaced external brushes 80 while the assembly is not is use. This handle top element channel 27 also provides a notch on the same side of the handle assembly as the handle base element notch 29 to the assist in separating the handle base element 24 from the handle top element 25 for cleaning and maintenance of the handle 20, FIGS. 1-2C, 7 and 10.

An embodiment of the hand-held reusable drinking straw wash tool assembly 10 provides octagonal side surfaces for the handle base element 24 and the handle top element 25, with two opposing sides having equal lengths longer than the six other equal length sides, FIGS. 7-10. For this preferred embodiment, the handle top element flanged end is circular 22, with a circumference that is larger than the octagonal side of the top element 25, and the octagonal side surfaces for the handle base element 24 and the handle top element 25 are sized to correspond once the two elements are aligned vertically along the longitudinal central axis 26, FIGS. 1-2C, and 7-10.

An embodiment of the hand-held reusable drinking straw wash tool assembly 10 further provides six equal sized external brushes 80, each external brush 80 having a first end sized to be received and held by one of the equal sized array of openings 33 concentrically and equally spaced about the handle base element longitudinal central axis 26 on the handle base element distal end surface, a second end sized to be received and held by one of the equal sized array of openings 54 concentrically and equally spaced about the handle base element longitudinal central axis 26 on the guide element 50 proximal end surface, and a length of bristles between the external brush first end and the external brush second end. The assembled hand-held reusable drinking straw wash tool assembly thus provides an array of external brush bristles equally spaced about the handle top element central bore 30 along the longitudinal central axis 26, FIGS. 2A, 2B, and 3. For preferred embodiments of the reusable straw wash tool assemblies, 10 or 12, each external brushes 80 is a standard 6 mm brush having an approximate ~6.5 mm brush bristle diameter, cut to length depending on the straw size. It is understood that depending on reusable straw diameter, the brush length and brush bristle length may be suitably adjusted.

Figure 3:
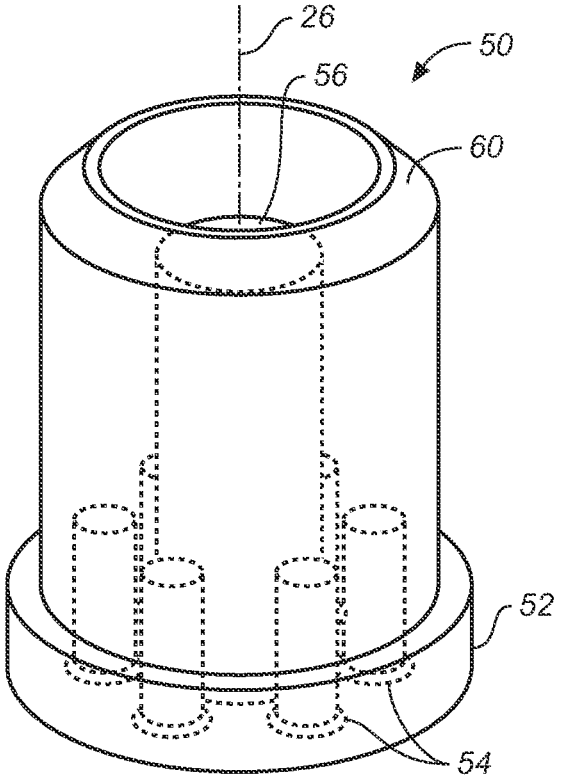
FIG. 3 is a top perspective view of the guide element 50 for embodiments of the hand-held apparatus 10 for washing and cleaning reusable drinking straws.
Figure 4:
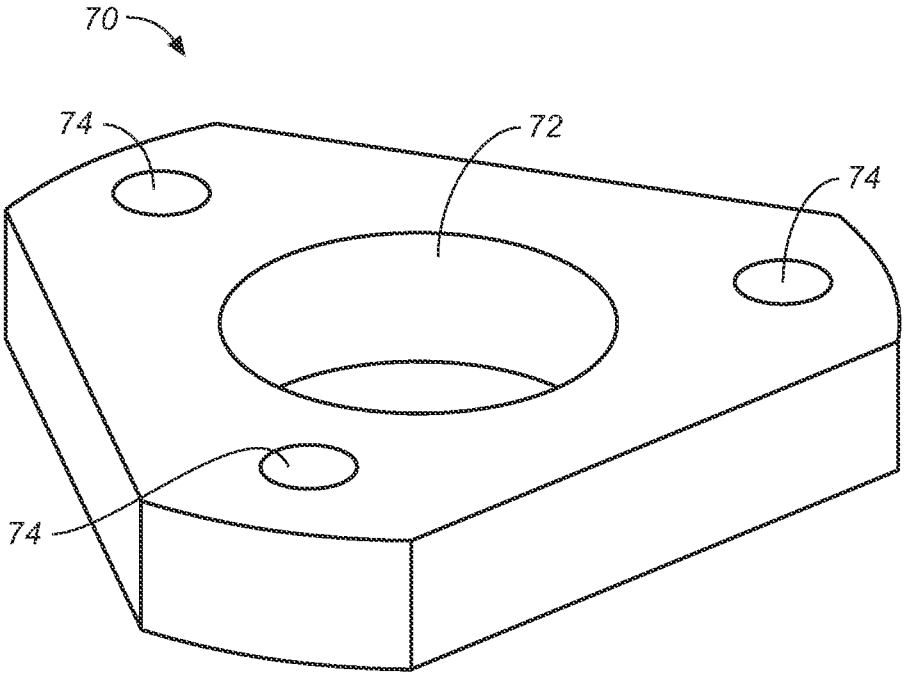
FIG. 4 is a distal end top perspective view of the retainer collar element 70 for embodiments of the apparatus for washing and cleaning reusable drinking straws.

An embodiment of the hand-held reusable drinking straw wash tool assembly 10 further includes a retainer element 70 with central opening 72 having a diameter sized to correspond to the diameter of the guide element 50, FIGS. 3 and 4, and a distal side surface having three equal sized openings 74 equally spaced about the retainer central opening 72 and corresponding to the three threaded equal sized openings 34 on the handle top element 25 flanged surface, FIG. 9.

An embodiment of the hand-held drinking straw wash tool assembly 10 also includes the guide element 50 which provides a distal end 60 sized to be received and secured by the retainer 70 and a flanged proximal end 52, a central axis 26 aligned with the handle base element longitudinal central axis 26, and a guide element central bore 56 sized to receive a drinking straw diameter. Six equal sized openings 54 are concentrically disposed around the guide element central bore 56 on the guide element flanged proximal end surface, each equal sized opening sized to receive and secure an external brush second end, FIGS. 1-2C, 3, and 4. The guide element central bore 56 diameter is smaller than the diameter of the hand-held handle top element central bore 30, FIGS. 1, 9 and 10.

An embodiment of the hand-held drinking straw wash tool assembly 10 has threaded fasteners sized to be received through the two equal sized openings on the handle base element proximal end surface 19 and into the two equal sized handle top element proximal end threaded openings 21 securing the handle base element to the handle top element, FIGS. 1-2C, and 7-10.

An embodiment of the hand-held drinking straw wash tool assembly 10 has threaded fasteners sized to be received through the three equal sized threaded openings in the retainer collar and threaded into the three threaded equal sized openings on the handle top element flanged surface securing the retainer element 70 and the guide element 50 to the handle top element 25, FIGS. 1-2C.

For an embodiment of the hand-held reusable drinking straw wash tool assembly 10 a flexible central brush 120, FIGS. 2A and 2B, is provided, having a flexible stainless-steel length, a threaded proximal end 40, and a second distal end providing a length of bristles. The flexible central brush threaded attachment threaded proximal end 40 is sized to be received by the single equal sized threaded opening 35 centered on the hand-held handle longitudinal central axis 26, FIG. 7. The flexible central brush 120 can be replaced by simply unscrewing it from the hand-held handle 20 and screwing in a new flexible central brush 120, both actions accomplished by gripping the shank of the flexible central brush 120 without disassembling the assembly. In preferred embodiments of the hand-held, reusable drinking straw wash tool assembly 10, or the free-standing hand-held, reusable drinking straw wash tool assembly 12, the flexible central brush 120 is a 9 mm brush inside diameter—cut to a length that enables the brush bristles to reach a substantial portion of the straw length. The flexible central brush 120 allows both the hand-held, reusable drinking straw wash tool assembly 10 and the free-standing, reusable drinking straw wash tool assembly 12 embodiments to scrub and clean curved reusable straws and straight reusable straws FIGS. 2C and 6.

Figure 5:
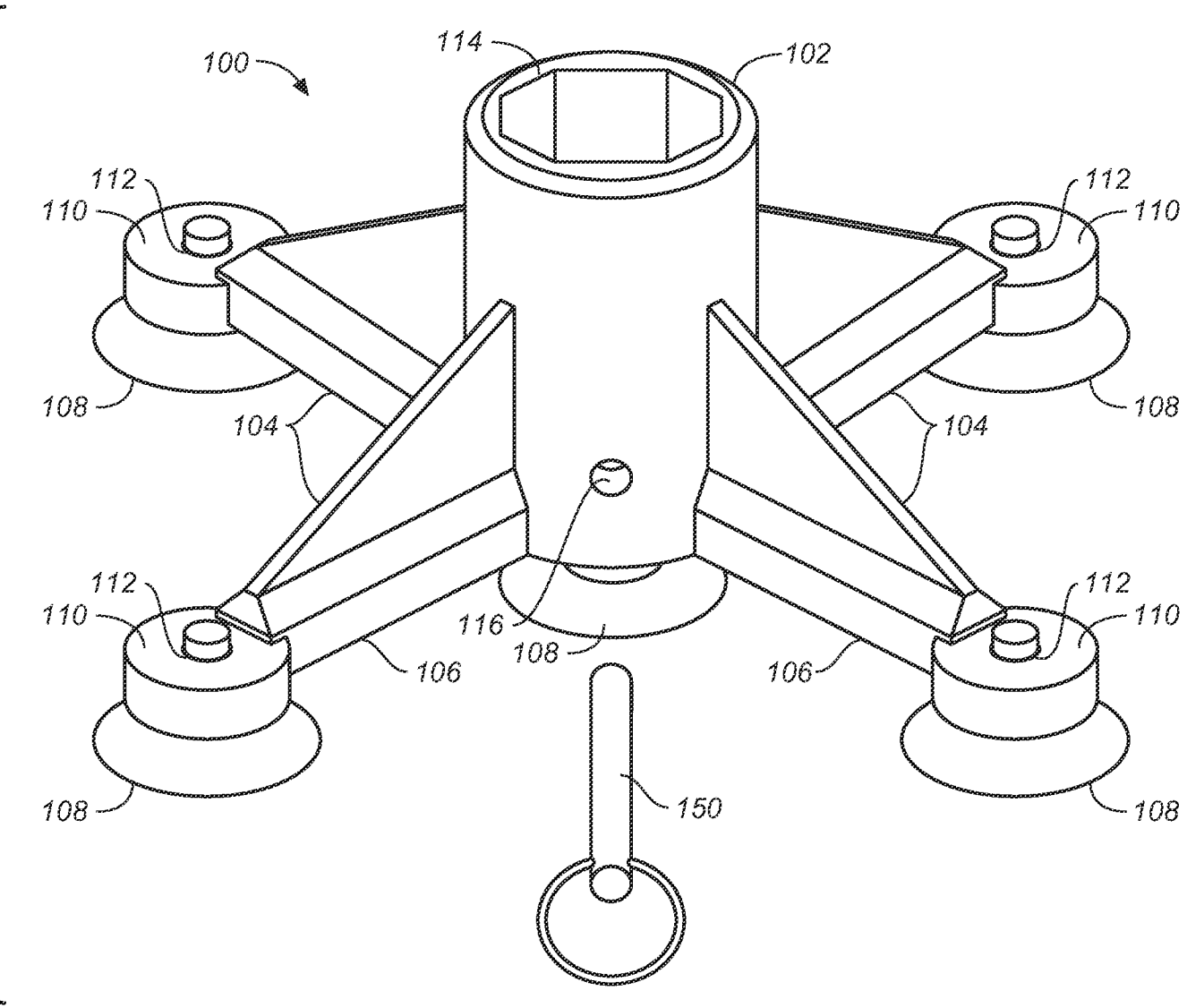
FIG. 5 is a top perspective view of the base element 100 for embodiments of the free-standing 12 apparatus for washing and cleaning reusable drinking straws.
Figure 6:
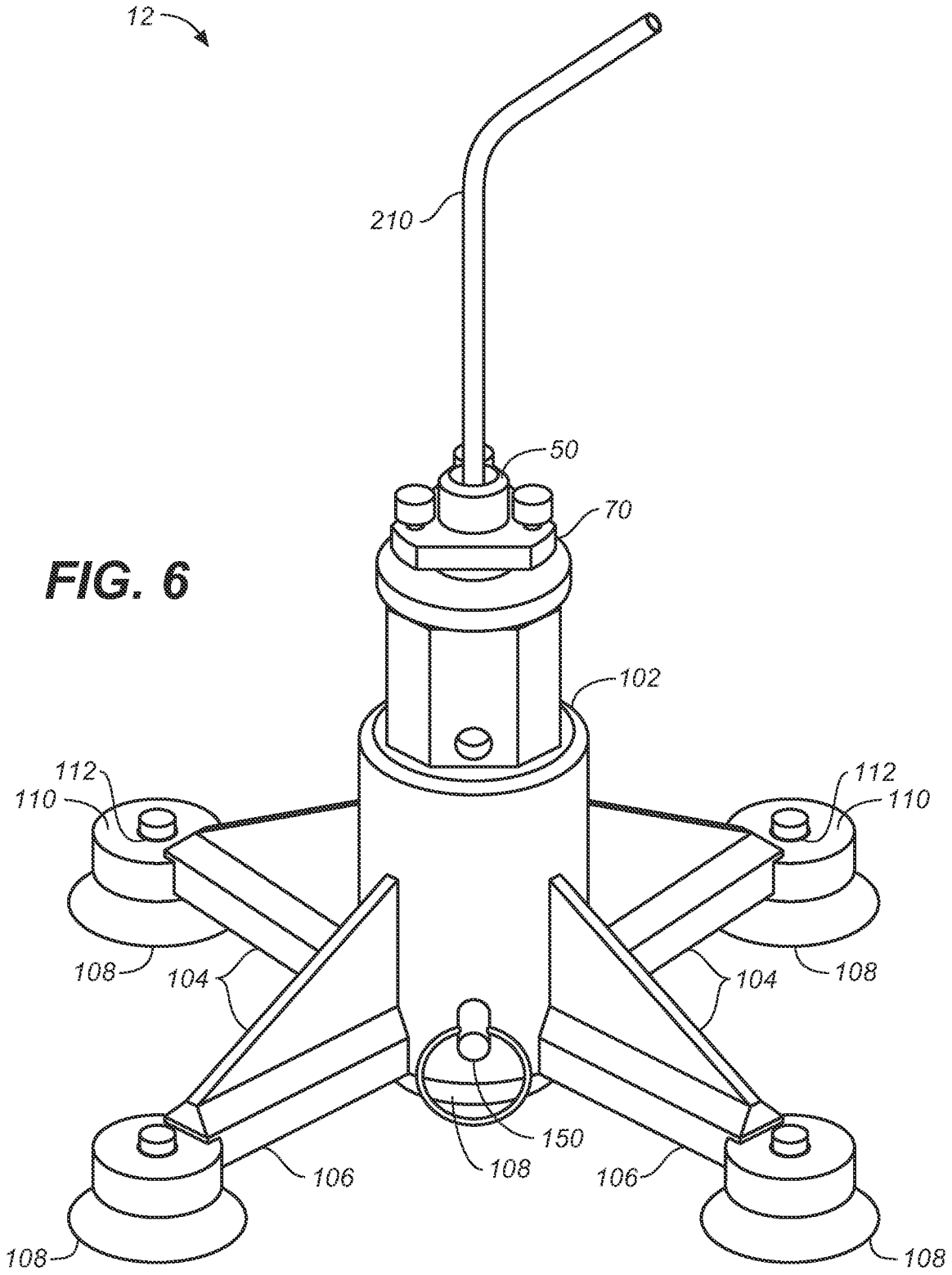
FIG. 6 is a top perspective view of an embodiment of the free-standing apparatus 12 for washing and cleaning reusable drinking straws with a bent metal drinking straw 210 engaged with the apparatus.

An embodiment of the free-standing assembled reusable drinking straw wash assembly, 12, provides a base 100, FIGS. 5 and 6. The base 100 includes a central stand 102 having an open top end 114 sized to receive, stabilize and vertically hold the handle base element 24, and dual side openings 116 having diameters corresponding to the handle base element aperture 28. A plurality of base radial arms 104 are provided, each base radial arm having a first end 106 affixed to the bottom end of the central stand 102. Each radial arm 104 further provides a second end including a stabilizing disk 110. Each base stabilizing disk 110 has a central opening 112. A rubber suction cup 108 sized to be received and held by each central base stabilizing disk central opening 112 such that a suction cup 108 concave portion is disposed face down under each stabilizing disk 110. A detent pin 150 sized to be received within central stand dual side openings 116 and the hand-held handle proximal end aperture 28 is provided to securely lock the handle 20 into the base 100, FIG. 6. In this fashion, the base 100 can be secured to the bottom surface of a wash basin by the suction cups to support the free-standing reusable drinking straw wash assembly 12 in an orthogonal position to the wash basin bottom surface during reusable straw washing.

An embodiment of the free-standing assembled reusable drinking straw wash assembly, 12, provides a central stand 102 with a central opening centered on the bottom surface (not depicted) A rubber suction cup 108 sized to be received and held by central opening centered on the central stand 102 bottom surface such that a suction cup 108 concave portion is disposed face down under the central stand 108, FIGS. 5 and 6.

An embodiment of the assembled free-standing assembled reusable drinking straw wash assembly, 12, provides a detent pin 150 having a diameter of 6.5 mm, FIGS. 5 and 6.

Thus, embodiments of the free-standing, reusable drinking straw wash tool assembly 12 can be secured to the bottom surface of a sink filled with hot water and a suitable cleaning solution. A curved reusable straw 210 or a straight reusable straw 200 is inserted onto the flexible central brush 120, FIGS. 2C and 6, into the guide element, and into the concentric external brush array in the handle element top element. As the reusable drinking straw 200 or 210 is forced along the flexible central brush 120 and through the guide element bore 56 the external brush 80 bristles contact and clean the external surface of the reusable drinking straw 200 or 210 aided by the pressure of the handle top element central bore 30 along the longitudinal axis 26 of the handle 20, FIGS. 1-2C, and 6.

The respective straw is then retracted from the respective wash tool assembly, turned around and reinserted into the wash tool assembly in the same fashion. In this manner, the entire internal surface of the reusable drinking straw and three inches of each end of the external surface of the reusable drinking straw is scrubbed and cleaned. These areas of wash tool assembly cleaning are adequate to address a user's mouth and/or saliva contact points on the reusable drinking straw. The remaining external surface of the reusable drinking between the three inches on either end is typically cleaned by methods used for silverware, such as a dishwasher.

The hand-held, reusable drinking straw wash tool assembly 10 embodiment achieves the same straw cleaning result by a user wearing rubber gloves submersing the reusable straw and assembly into a depth of hot water and cleaning solution after the straw has been inserted into the assembly in the similar manner as with the free-standing embodiment, FIGS. 1-2C.

An embodiment of the reusable drinking straw wash tool assembly 510 includes a base element 524, FIGS. 12A, 12B, 14-16. The base element 524 provides a distal end surface, FIG. 7, a proximal end surface, FIG. 8, and a longitudinal central axis 526 common to all elements of the assembled reusable drinking straw wash tool assembly 510, FIGS. 11, 13. The base element 524 includes at least four side surfaces. Seven openings are included on the base element distal end surface. Six of the openings are an array of concentrically equally spaced and equal sized openings 533 about the base element longitudinal central axis 526. The seventh opening 535 provides a stainless-steel threaded opening centered on the handle base element longitudinal central axis 526. Two equal sized openings 519 are included on opposite sides of the array of the concentrically and equally spaced openings 533 about the longitudinal central axis 526 of the base element distal end surface. The two equal sized openings 519 extend through the entire base element providing access from the handle base element distal end surface to the base element proximal end surface. An embodiment of the reusable drinking straw wash tool assembly 510 provides a stainless-steel insert through each equal sized opening 519.

The base element 524 includes a plurality of base radial arms 604 oriented at equal angles one from the other orthogonally to the reusable drinking straw wash tool assembly 510 common longitudinal central axis 526, each base radial arm 604 having a first end 606 affixed to a side of the base element 524, 11, 13, 14-16. Each radial arm 604 further provides a second end including a stabilizing disk 610. Each base stabilizing disk 610 has a central opening 612. A rubber suction cup 608 sized to be received and held by each central base stabilizing disk central opening 612 such that a suction cup 608 concave portion is disposed face down under each stabilizing disk 610. The base element 524 can be secured to the bottom surface of a wash basin by the suction cups 608 to support the reusable drinking straw wash assembly 510 in an orthogonal position to the wash basin bottom surface during reusable straw washing.

An embodiment of the free-standing assembled reusable drinking straw wash assembly 510 provides a base element 524 with a central opening centered on the bottom surface. A rubber suction cup 608 is sized to be received and held by central opening centered on the base element 524 bottom surface such that a suction cup 608 concave portion is disposed face down under the base element 524, FIGS. 14-16.

Figure 12A:
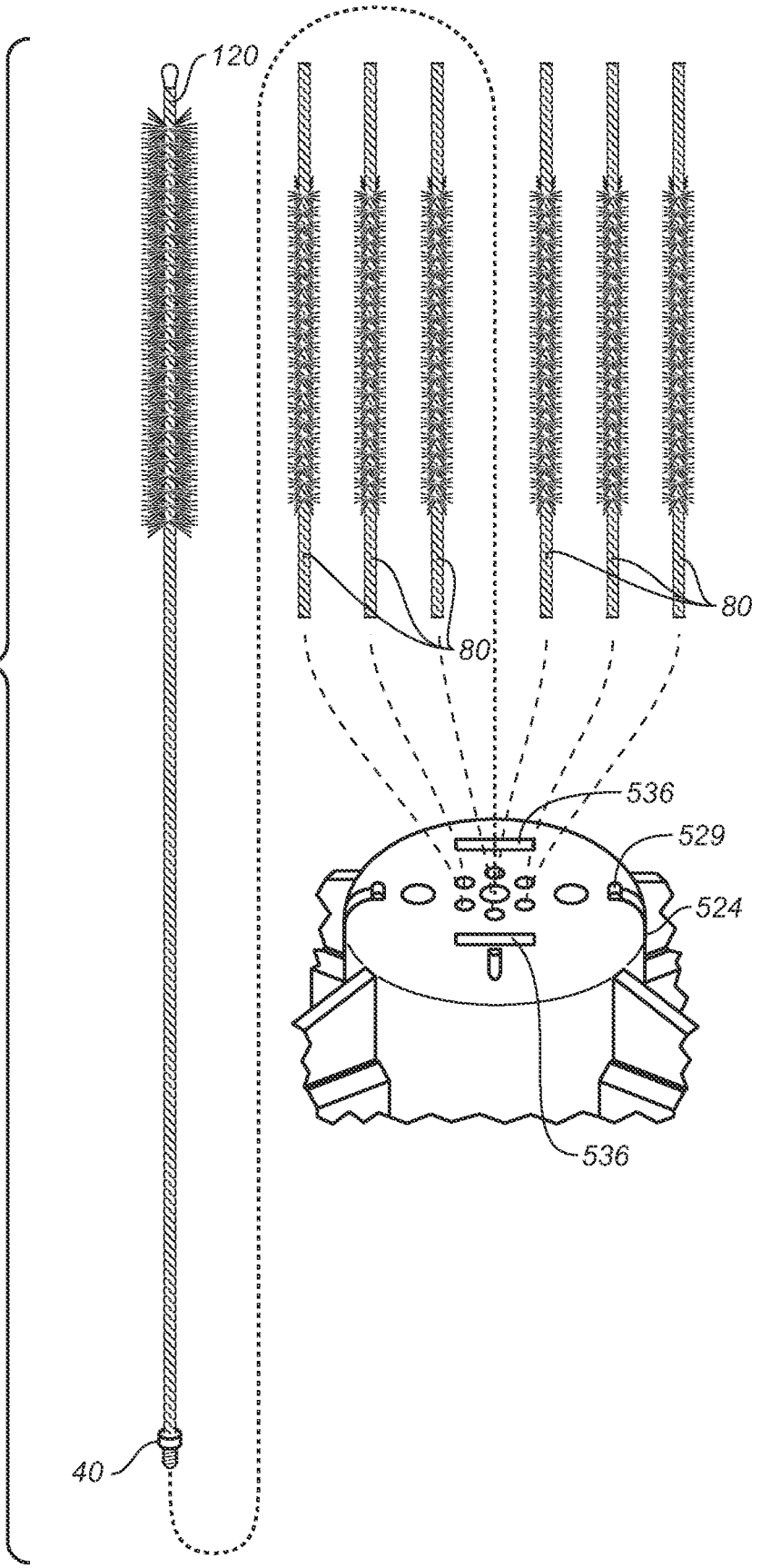
FIG. 12A is an exploded view of the brushing elements and the distal end top perspective view of the base element 524 for an embodiment of the reusable straw wash tool assembly 510.

An embodiment of the hand-held reusable drinking straw wash tool assembly 510 includes a notch 529 in a base element 524 side and distal end surface, FIG. 12A. This notch 529 provides access to the assist in separating the base element 524 from the external brush housing element 525 for cleaning and maintenance of the reusable drinking straw wash tool assembly 510.

Figure 11:
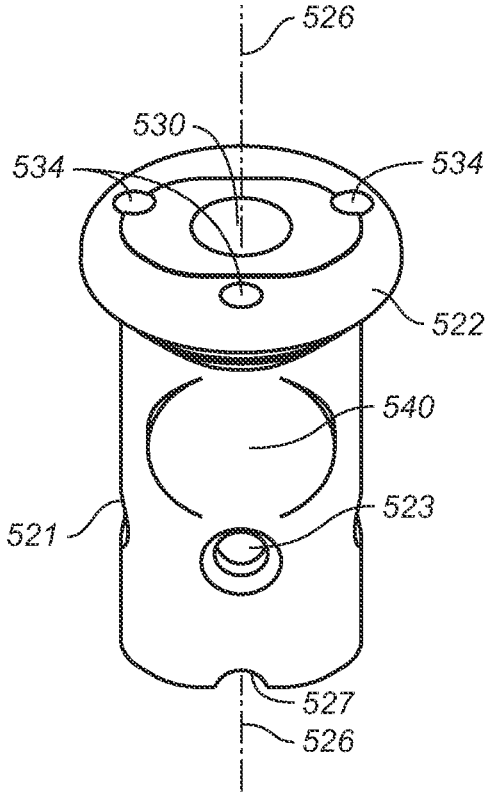
FIG. 11 is a distal end top perspective view of the external brush housing element 525 for an embodiment of the reusable straw wash tool assembly 510.

An embodiment of the reusable drinking straw wash tool assembly further includes an external brush housing element 525 providing a proximal end surface, FIG. 11, sized to correspond to the base element distal end surface, an external brush housing element longitudinal central axis 526 corresponding to the longitudinal central axis 526 of the base element 524, and a flanged external brush housing element distal end surface 522. The flanged external brush housing element distal end surface 522 includes three equal sized threaded openings 534 equally spaced about the external brush housing element longitudinal central axis 526. The external brush housing element 525 further includes at least four side surfaces sized to correspond to the base element 524 at least four side surfaces and provides ergonomic planar gripping surfaces 540 around the external brush housing element 525 side surfaces below the flanged external brush housing element distal end surface 522. A central bore 530 having a diameter sized slightly less than the diameter of the array of concentrically and equally spaced openings in the external brush housing element 524 distal end surface through the entire external brush housing element along the longitudinal central axis 526 provides access from the external brush housing element distal end surface to the external brush housing element proximal surface. Two equal sized threaded openings 521 are included on opposite sides of the central bore 530 on external brush housing element proximal end surface, FIG. 18, sized and positioned to correspond to the two openings 519 on opposite sides of the array of the concentrically and equally spaced openings about the longitudinal central axis of the base distal end surface FIG. 14. Detent alignment guides 536 on the base element distal end surface provide guides the external brush housing element proximal end surface to facilitate in quick alignment of the two respective elements, FIGS. 12A and 18.

An embodiment of the hand-held reusable drinking straw wash tool assembly 510 further includes an external brush housing element aperture 523 orthogonally disposed to the longitudinal central axis 526 through the external brush housing element 525, and that is accessible from opposing sides of the external brush housing element 525, FIG. 11. This external brush housing element aperture 523 transects to the central bore 530 and allows fluid flow into and from the central bore 530 from either opposing external brush housing element 525 side for cleaning solutions into the central bore 530 and to the concentrically and equally spaced external brushes 80 housed while cleaning the outside surface of a reusable straw 200. This external brush housing element aperture 523 also enhances air drying of the central bore 530 and the concentrically and equally spaced external brushes 80 while the assembly is not is use.

An embodiment of the reusable drinking straw wash tool assembly 510 includes an external brush housing element channel 527 orthogonally disposed to the longitudinal central axis 526. This external brush housing element channel 527 is provided through the external brush housing element proximal surface and is accessible from opposing sides of the external brush housing element, FIG. 11. This external brush housing element channel 527 transects the central bore 530 to allows fluid flow into and from the central bore 530 from either opposing external brush housing element side for cleaning solutions into the central bore 530 and to the concentrically and equally spaced external brushes 80 housed while cleaning the outside surface of a reusable straw 200. This external brush housing element channel 527 also enhances air drying of the central bore 530 and the concentrically and equally spaced external brushes 80 while the assembly is not is use. This external brush housing element channel 527 also provides a notch on the same side of the handle assembly as the base element notch 529 to the assist in separating the base element 524 from the external brush housing element 525 for cleaning and maintenance of the reusable drinking straw wash tool assembly 510.

An embodiment of the hand-held reusable drinking straw wash tool assembly 510 provides octagonal side surfaces for the base element 524 and the external brush housing element 525, with two opposing sides having equal lengths longer than the six other equal length sides. For this preferred embodiment, the external brush housing element flanged end is circular 522, with a circumference that is larger than the octagonal side of the external brush housing element 525, and the octagonal side surfaces for the base element 524 and the external brush housing element 525 are sized to correspond once the two elements are aligned vertically along the longitudinal central axis 526.

An embodiment of the reusable drinking straw wash tool assembly 510 further provides six equal sized external brushes 80, each external brush 80 having a first end sized to be received and held by one of the equal sized array of openings 533 concentrically and equally spaced about the base element longitudinal central axis 526 on the base element distal end surface, a second end sized to be received and held by one of the equal sized array of openings 554 concentrically and equally spaced about the base element longitudinal central axis 526 on the guide element 550 proximal end surface, and a length of bristles between the external brush first end and the external brush second end, FIGS. 12A-14. The assembled reusable drinking straw wash tool assembly 510 thus provides an array of external brush bristles equally spaced about the top element central bore 530 along the longitudinal central axis 526, FIG. 11. For some embodiments of the reusable straw wash tool assembly 510 each of the external brushes 80 is a standard 6 mm brush having an approximate ~6.5 mm brush bristle diameter, cut to length depending on the straw size. It is understood that depending on reusable straw diameter, the brush length and brush bristle length may be suitably adjusted.

Figure 15:
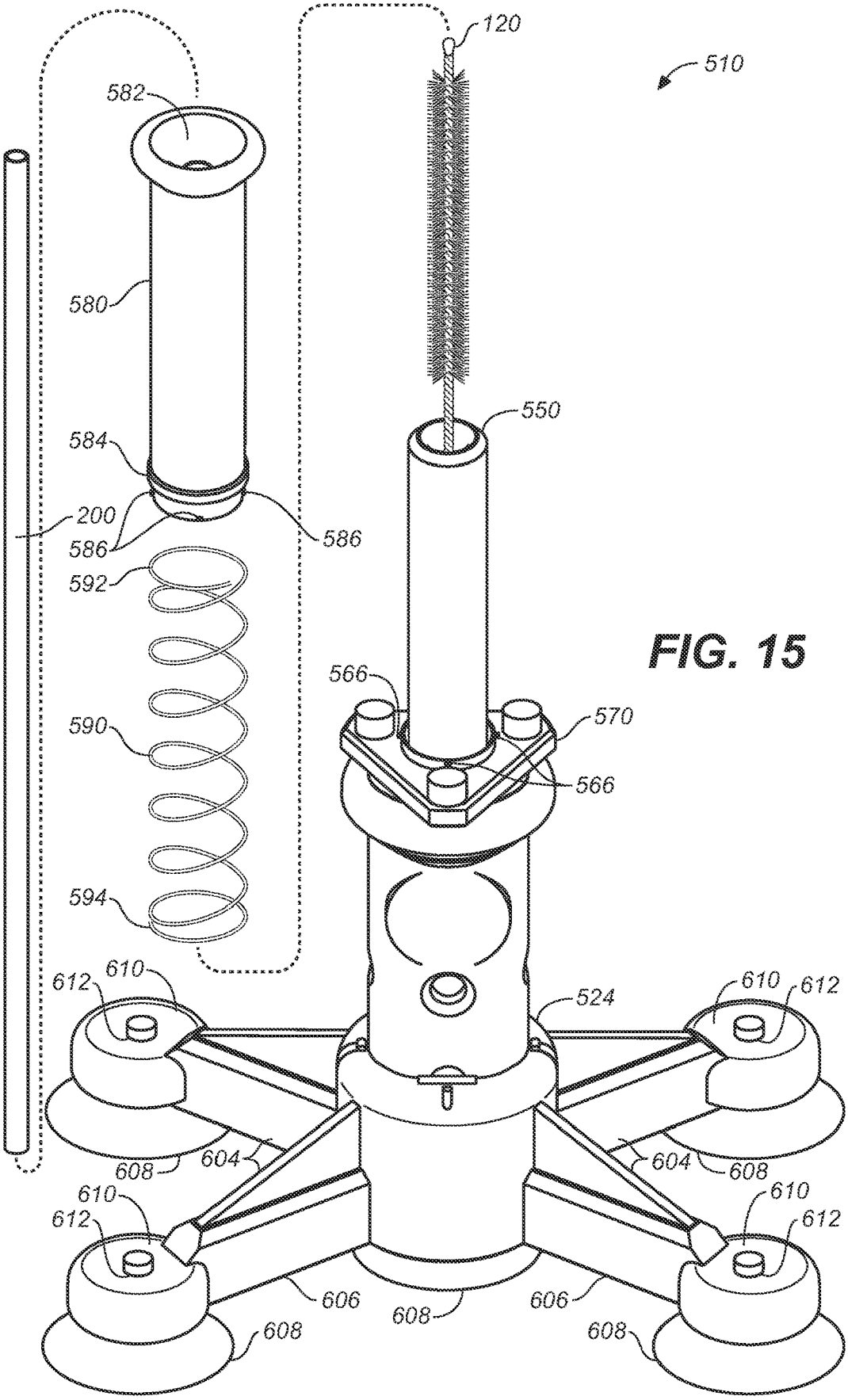
FIG. 15 is an exploded view of an embodiments of the reusable straw wash tool assembly 510 depicting the cylindrical straw funnel element 580, resilient spring 590, and reusable straw 200.
Figure 16:
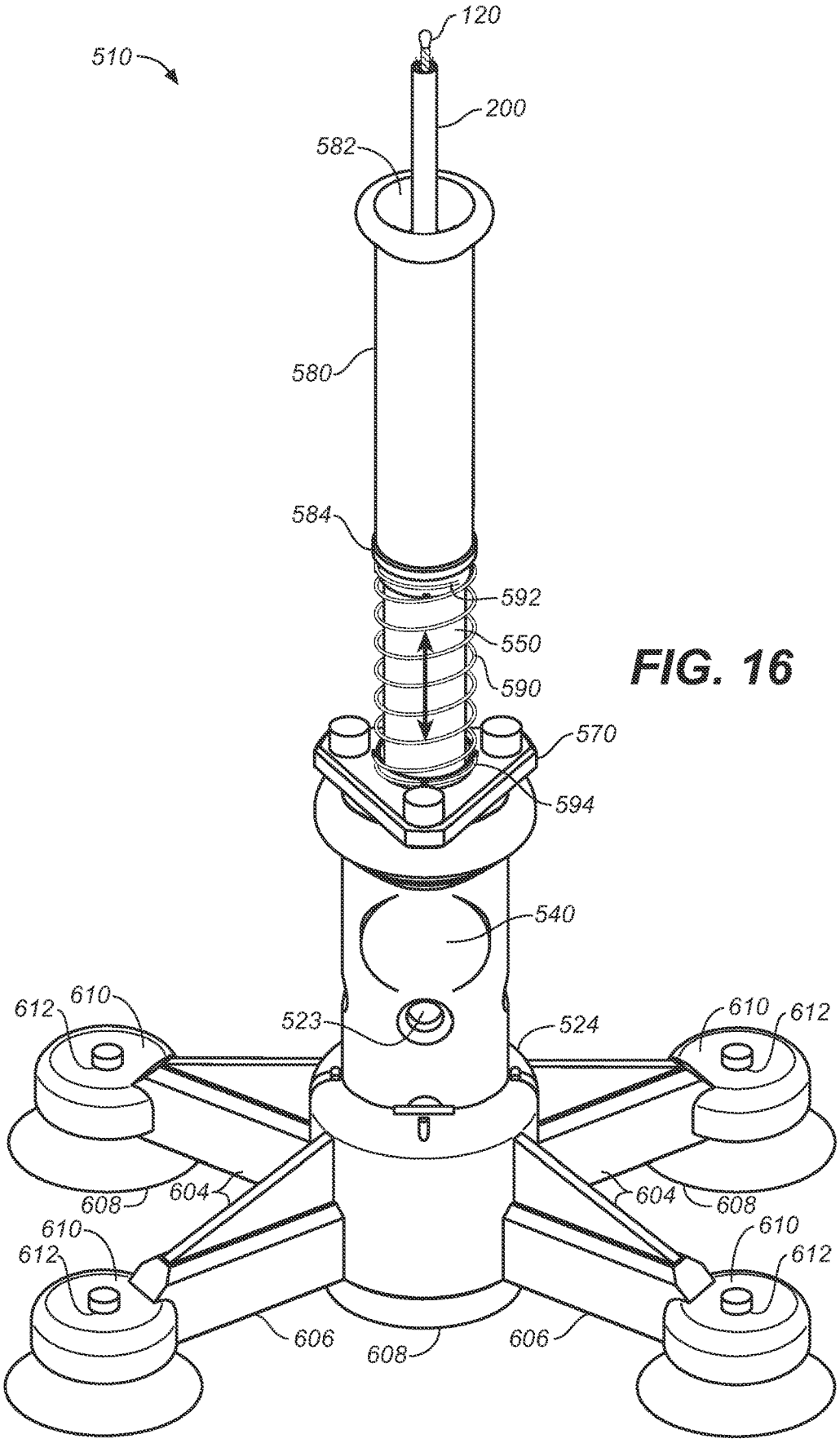
FIG. 16 is an assembled view of FIG. 15 depicting the action of the cylindrical straw funnel element 580 in relation to the guide element 550 during the washing phase of one end of the reusable straw 200.
Figure 17:
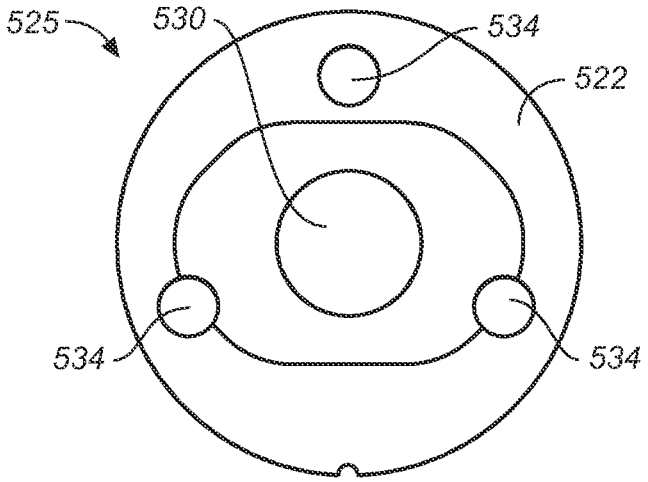
FIG. 17 is a planar view of the external brush housing element 525 distal surface.

An embodiment of the hand-held reusable drinking straw wash tool assembly 510 further includes a cylindrical straw funnel element 580 with a tapered distal end central opening 582 throughout the straw funnel element 580 along the longitudinal central axis 526 and having a proximal end 584 diameter sized to receive and correspond to the diameter of the guide element distal end 560 providing access for a straw 200 inserted into the straw funnel element tapered distal end central opening 582 to be extended into and through the guide element central bore 556 and into the external brush housing central bore 530, FIGS. 15 and 16. A resilient spring 590 is sized to receive and correspond to the diameter of the guide element distal end 560. The resilient spring distal end 592 is attached to four equal sized detents 586 spaced equally around the periphery of the circumference of the straw funnel element proximal end 584. As the straw 200 is inserted into the cylindrical straw funnel element 580 through the guide element 550 and into external brush housing element 525, the resilient spring is compressed as the cylindrical straw funnel element proximal end is extended along the guide element distal end 560 to the furthest extent. The user grips the straw distal end extending from the straw funnel element tapered distal end central opening 582 and withdraws the straw from the reusable drinking straw wash tool assembly 510. The resilient spring returns the straw funnel element to its starting position allowing the user to reinsert the other end of the uncleaned straw 200 into the cylindrical straw funnel element 580 through the guide element 550 and into external brush housing element 525. If both ends of the straw 200 have been inserted into the reusable drinking straw wash tool assembly 510 and cleaned, the next uncleaned straw 200 is inserted into the straw funnel element tapered distal end central opening 582 and the cleaning process is repeated.

An embodiment of the reusable drinking straw wash tool assembly 510 further includes a retainer collar element 570 with central opening 572 having a diameter sized to correspond to the diameter of the guide element 550, FIGS. 3 and 4, and a distal side surface having three equal sized openings 574 equally spaced about the retainer collar element central opening 572 and corresponding to the three threaded equal sized openings 534 on the external brush housing element 525 flanged surface, FIG. 9. The resilient spring proximal end 594 is attached to four equal sized detents 566 spaced equally around the periphery of the circumference of the retainer collar element central opening 572, FIGS. 12B and 16.

Figure 12B:
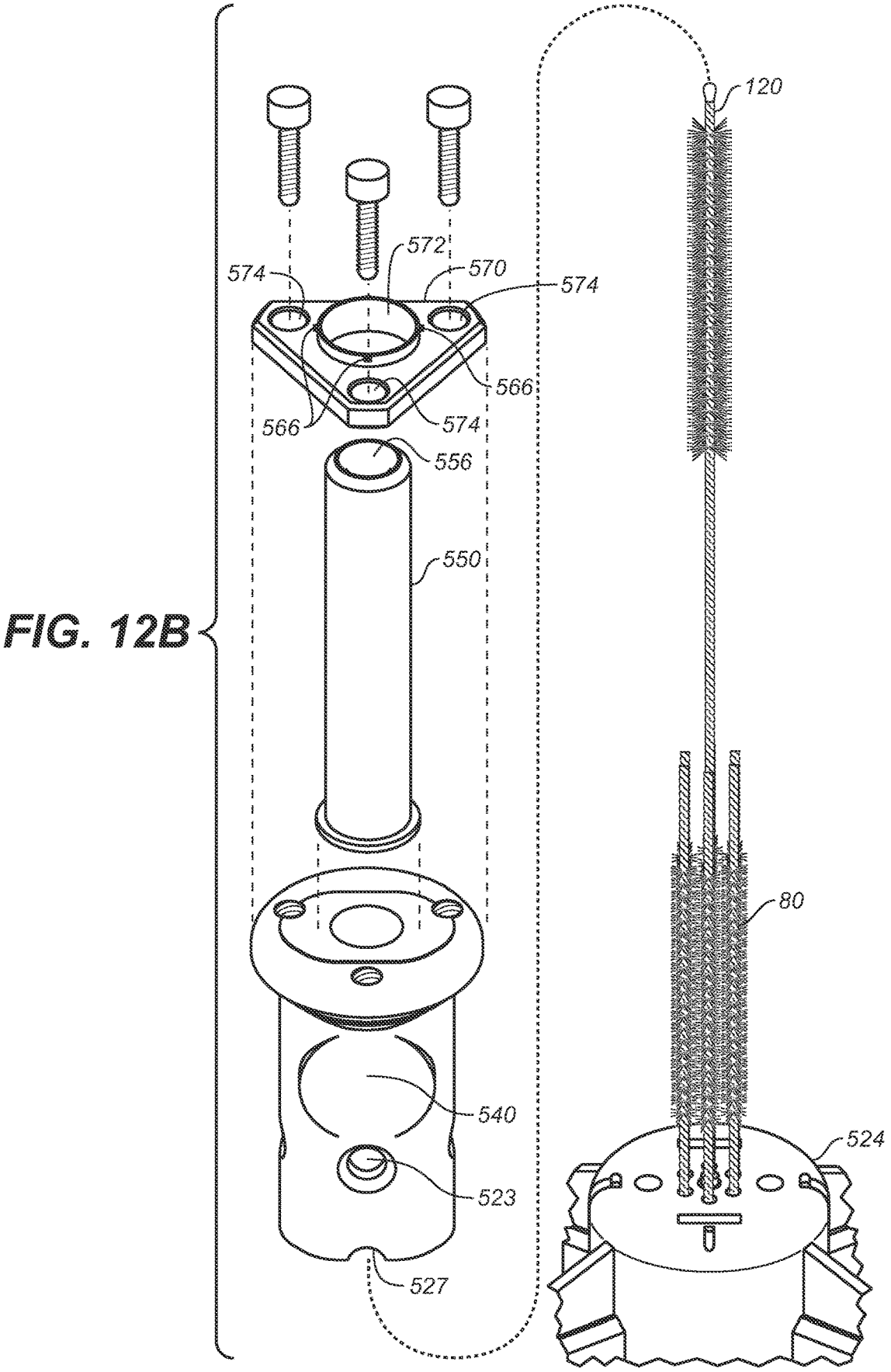
FIG. 12B an exploded view of the distal end top perspective view of the of the external brush housing element 525, guide 550, and guide retainer 570 in relation to the base element 524 and brushing elements of FIG. 12A for an embodiment of the reusable straw wash tool assembly 510.
Figure 13:
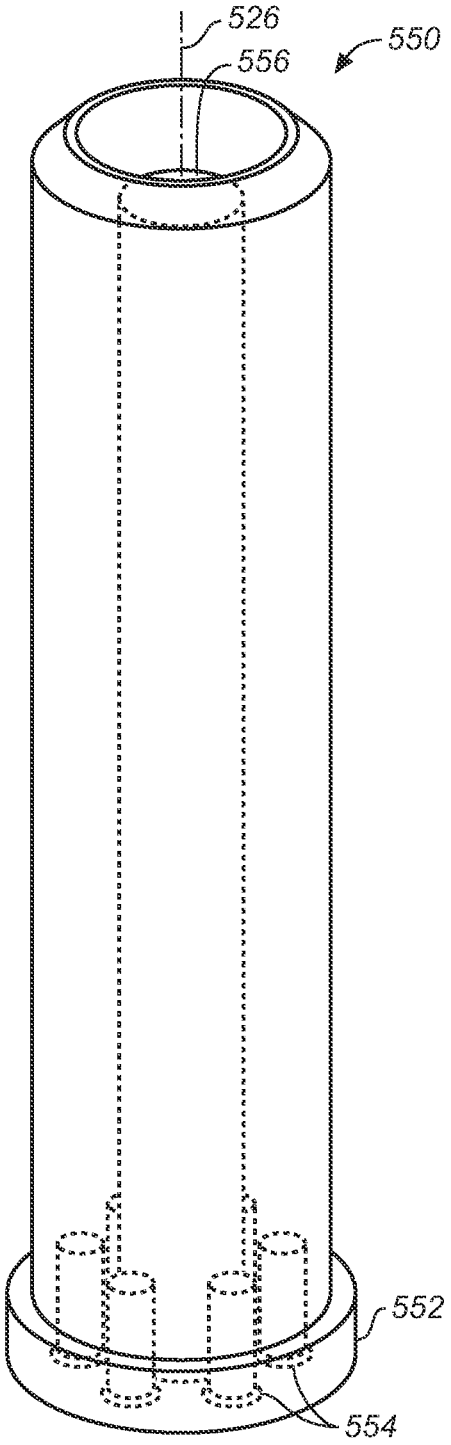
FIG. 13 is a top perspective view of the guide element 550 for embodiments of the reusable straw wash tool assembly 510.

An embodiment of the reusable drinking straw wash tool assembly 510 also includes the guide element 550 which provides a distal end 560 sized to be received through and secured by the retainer collar element 570 and a flanged proximal end 552, a central axis 526 aligned with the handle base element longitudinal central axis 526, and a guide element central bore 556 sized to receive a drinking straw diameter, FIGS. 12B and 13. Six equal sized openings 554 are concentrically disposed around the guide element central bore 556 on the guide element flanged proximal end surface, each equal sized opening sized to receive and secure an external brush second end. The guide element central bore 556 diameter is smaller than the diameter of the external brush element central bore 530, FIGS. 11 and 12B.

Figure 14:
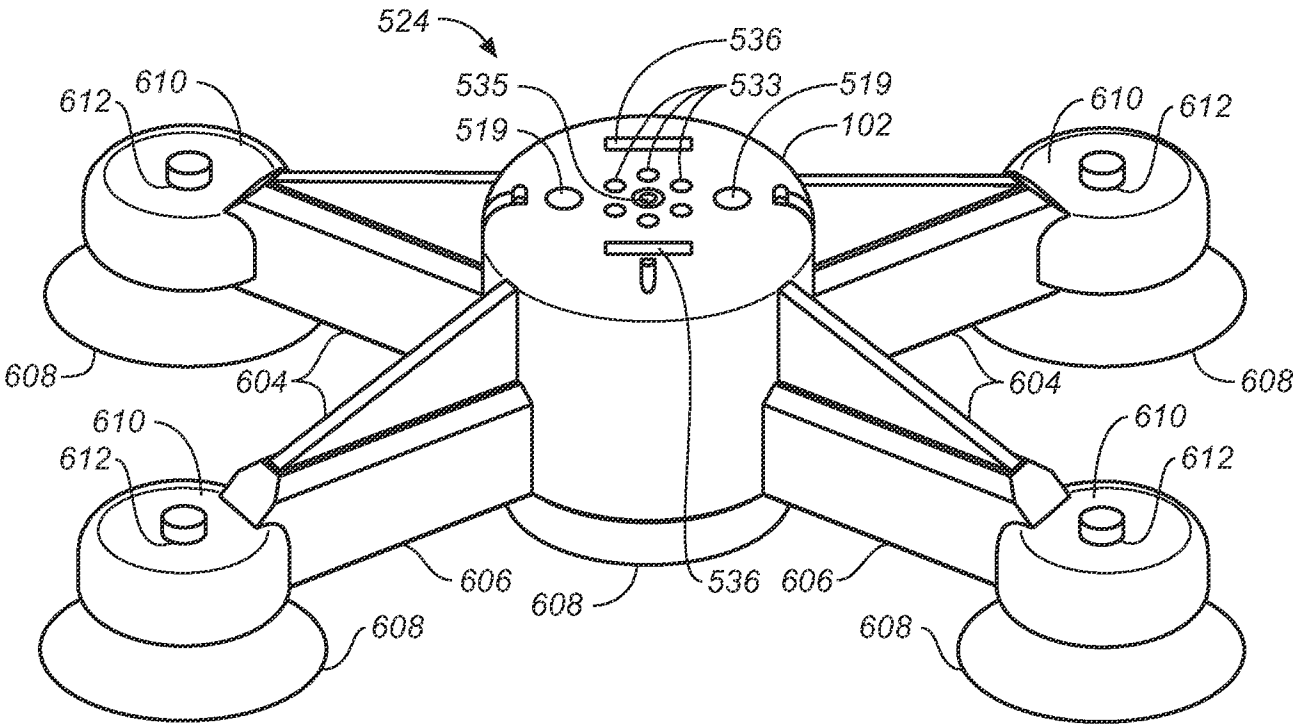
FIG. 14 is a distal end top perspective view of the base element 524 for an embodiment of the reusable straw wash tool assembly 510.
Figure 18:
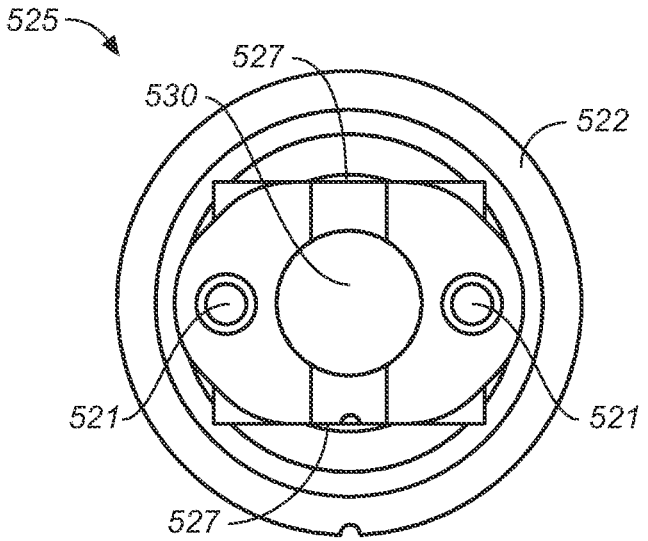
FIG. 18 is a planar view of the external brush housing element 525 proximal surface.

An embodiment of the reusable drinking straw wash tool assembly 510 has threaded fasteners sized to be received through the two equal sized openings on the base element proximal end surface 519 and into the two equal sized external brush housing element proximal end threaded openings 521 securing the base element 524 to the external brush housing element 525, FIGS. 14 and 18.

An embodiment of the reusable drinking straw wash tool assembly 510 has threaded fasteners sized to be received through the three equal sized threaded openings in the retainer collar and threaded into the three threaded equal sized openings on the handle top element flanged surface securing the retainer element 550 and the guide element 570 to the external brush housing element 525, FIGS. 12B, 15, and 16.

For an embodiment of the reusable drinking straw wash tool assembly 510 a flexible central brush 120, FIGS. 12A, 12B, 15 and 16, is provided, having a flexible stainless-steel length, a threaded proximal end 40, and a second distal end providing a length of bristles. The flexible central brush threaded attachment threaded proximal end 40 is sized to be received by the single equal sized threaded opening 535 centered on the longitudinal central axis 526. The flexible central brush 120 can be replaced by simply unscrewing it from the reusable drinking straw wash tool assembly 510 and screwing in a new flexible central brush 120, both actions accomplished by gripping the shank of the flexible central brush 120 without disassembling the reusable drinking straw wash tool assembly 510. In embodiments of the reusable drinking straw wash tool assembly 510 the flexible central brush 120 is a 9 mm brush inside diameter—cut to a length that enables the brush bristles to reach a substantial portion of the straw 200 length. The flexible central brush 120 allows the reusable drinking straw wash tool assembly 510 to scrub and clean the inside surface of straight reusable straws 200 FIGS. 2C and 6.

It would be understood by persons having ordinary skill in the art that portions of elements of the hand-held handle 10 embodiments of the assembled reusable drinking straw wash tool called "distal" could be called "top" in embodiments of the free-standing assembled drinking straw wash tool 12 that provide the free-standing base 100, FIGS. 5 and 6 or the reusable drinking straw wash tool assembly 510, FIGS. 11-18. Similarly, it would be understood by persons having ordinary skill in the art that portions of elements of the hand-held handle 10 embodiments of the assembled reusable drinking straw wash tool called "distal" could be called "top" in embodiments of the free-standing assembled drinking straw wash tool 12 that provide the free-standing base 100, FIGS. 5 and 6 or the reusable drinking straw wash tool assembly 510, FIGS. 11-18.

I claim:

1. An assembly to clean a reusable drinking straw, the assembly comprising, in combination:

A. a base element comprising a solid body, a distal end surface and a proximal end surface, a longitudinal central axis, at least four side surfaces, seven openings on the base element distal end surface, wherein six openings are an array of concentrically equally spaced and equal sized openings about the longitudinal central axis and the seventh opening is threaded and centered on the longitudinal central axis, two equal sized openings on opposite sides of the array of the concentrically and equally spaced openings about the longitudinal central axis of the base distal end surface and through the entire base element providing access from the base element distal end surface to the base element proximal end surface;

B. the base element further comprising four radial arms, each base element radial arm comprising a first end affixed to a base element side, and a second end comprising a stabilizing disk, each stabilizing disk comprising a central opening whereby each base element radial arm is disposed about the base element longitudinal axis in an approximately ninety-degree orientation, one radial arm to the other next two radial arms, a rubber suction cup sized to be received and held by each central base stabilizing disk central opening such that a suction cup concave portion is disposed face down under each stabilizing disk;

C. an external brush housing element comprising a solid body, a proximal end surface sized to correspond to the base element distal end surface, a longitudinal central axis corresponding to the longitudinal central axis of the base element, a flanged distal end surface comprising three equal sized threaded openings equally, spaced about the longitudinal central axis, at least four side surfaces sized to correspond to the base element four side surfaces comprising ergonomic planar disc gripping surfaces on at least two opposing side surfaces below the flanged external brush housing element distal end surface, a central bore comprising a diameter sized to correspond to the diameter of the array of concentrically and equally spaced openings in the base element distal end surface through the entire external brush housing element solid body along the longitudinal central axis providing access from the external brush housing element distal end surface to the external brush housing element proximal surface, two equal sized threaded openings on opposite sides of the central bore on the external brush housing element proximal end surface sized and positioned to correspond to the two openings on opposite sides of the array of the concentrically and equally spaced openings about the longitudinal central axis of the base distal end surface;

D. six equal sized external brushes, each external brush comprising a first end sized to be received and held by one of the equal sized array of six openings concentrically and equally spaced about the base element longitudinal central axis on the base element distal end surface, a second end, and a length of bristles between the external brush first end and the external brush second end providing an array of external brush bristles equally spaced about the base element longitudinal central axis and extending through the external brush housing element bore;

E. a guide element comprising a flanged proximal end and a distal end sized to extend through and be received and secured by a retainer collar element, a central axis aligned with the base element longitudinal central axis, a guide element central bore comprising a diameter smaller than the external brush housing element central bore and sized to receive a drinking straw diameter, six equal sized openings on the guide element proximal end, concentrically disposed around the guide element central bore, each equal sized opening sized to receive and secure an external brush second end;

F. a cylindrical straw funnel element comprising a tapered distal end central opening throughout the straw funnel element along a straw funnel longitudinal central axis aligned with the base element longitudinal axis, a proximal end, a diameter sized to receive and correspond to the diameter of the guide element distal end providing access for a straw inserted into the straw funnel element tapered distal end central opening to be extended into and through the guide element central bore and into the external brush housing central bore;

G. a resilient spring sized to receive and correspond to the diameter of the guide element distal end and comprising a resilient spring distal end attached to four equal sized detents spaced equally around a periphery of the straw funnel element proximal end;

H. a retainer collar element comprising a central opening diameter sized to correspond to the diameter of the guide element distal end, a distal side surface comprising three equal sized openings equally spaced about retainer collar element central opening corresponding to the three threaded equal sized openings on the external brush housing element flanged surface, and four equal sized detents spaced equally around a periphery of the retainer collar central opening diameter, each detent fixedly attached to a resilient spring proximal end;

I. first equal sized threaded fasteners, each first equal sized fastener sized to be received through the two equal sized openings on the base element proximal end surface and threaded into the corresponding equal sized external brush housing element proximal end threaded openings securing the base element to the external brush housing element;

J. second equal sized threaded fasteners, each second equal sized threaded fastener sized to be received through one of the three equal sized threaded openings in the retainer collar element and threaded into a corresponding threaded equal sized opening on the external brush housing element flanged surface securing the guide element and the retainer collar element to the external brush housing element; and K. a flexible central brush comprising a threaded end sized to be received and held by the threaded opening centered on the base element distal end surface, a second end, and a length of bristles between the central brush threaded end and the central brush second end providing a length of flexible central brush element bristles extending through the six equal sized external brushes in the external brush housing element central bore and above and beyond the external brush housing element.

2. The assembly of claim 1, wherein the base element distal end surface and an external brush housing element surface further comprise a common single notch.

3. The assembly of claim 2, wherein the external brush housing element further comprises:

A. an external brush housing element aperture orthogonally disposed to the longitudinal central axis and transecting the external brush housing element central bore near a midpoint between the external brush housing element proximal and distal surfaces and accessible from opposing sides of the external brush housing element; and B. an external brush housing element channel orthogonally disposed to the longitudinal central axis and transecting the external brush housing element central bore on the external brush housing element proximal surface and accessible from opposing sides of the external brush housing element, one end of the external brush housing element channel comprising a notch on the same side of the external brush housing element as the side comprising a notch on the base element.

4. The assembly of claim 1, wherein the base element and the external brush housing element comprise octagonal side surfaces with two opposing sides having equal lengths longer than the six other equal length sides, and the external brush housing element flanged distal end surface is circular.

5. The assembly of claim 1, wherein the base element distal end surface comprises detent alignment guides to center and orient the external brush housing element proximal end surface to facilitate alignment of the two respective elements.

6. The assembly of claim 1, wherein the base element further comprises an aperture centered on a bottom surface and a rubber suction cup sized to be received and held by the aperture such that a suction cup concave portion is disposed face down under the base element.

7. An assembly to clean a reusable drinking straw, the assembly comprising, in combination:

A. a base element comprising a solid body, distal end surface and a proximal end surface, a longitudinal central axis, at least four side surfaces, seven openings on the base element distal end surface, wherein six openings are an array of concentrically equally spaced and equal sized openings about the longitudinal central axis and the seventh opening is threaded and centered on the longitudinal central axis, two equal sized openings on opposite sides of the array of the concentrically and equally spaced openings about the longitudinal central axis of the base distal end surface and through the entire base element providing access from the base element distal end surface to the base element proximal end surface;

B. an external brush housing element comprising a solid body, a proximal end surface sized to correspond to a base element distal end surface, a longitudinal central axis corresponding to the longitudinal central axis of the base element, a flanged distal end surface comprising three equal sized threaded openings equally, spaced about the longitudinal central axis, at least four side surfaces sized to correspond to the base element four side surfaces comprising ergonomic grip ridges on at least two opposing side surfaces below the flanged external brush housing element distal end surface, a central bore comprising a diameter sized to correspond to the diameter of the array of concentrically and equally spaced openings in the base element axis distal end surface through the entire external brush housing element solid body along the longitudinal central axis providing access from the external brush housing element distal end surface to the external brush housing element proximal surface, two equal sized threaded openings on opposite sides of the central bore on the external brush housing element proximal end surface sized and positioned to correspond to the two openings on opposite sides of the array of the concentrically and equally spaced openings about the longitudinal central axis of the base distal end surface;

C. six equal sized external brushes, each external brush comprising a first end sized to be received and held by one of the equal sized array of six openings concentrically and equally spaced about the base element longitudinal central axis on the base element proximal distal end surface, a second end, and a length of bristles between the external brush first end and the external brush second end providing an array of external brush bristles equally spaced about the base element longitudinal central axis and extending through the external brush housing element bore;

D. a guide element comprising a flanged proximal end and a distal end sized to be received and secured by a retainer element, a central axis aligned with the base element longitudinal central axis, a guide element central bore comprising a diameter smaller than the diameter of the external brush housing element central bore and sized to receive a drinking straw diameter, six equal sized openings on the guide element proximal end, concentrically disposed around the guide element central bore, each equal sized opening sized to receive and secure an external brush second end;

E. a cylindrical straw funnel element comprising a tapered distal end central opening throughout the straw funnel element along a straw funnel longitudinal central axis aligned with the base element longitudinal axis, a proximal end, a diameter sized to receive and correspond to the diameter of the guide element distal end providing access for a straw inserted into the straw funnel element tapered distal end central opening to be extended into and through the guide element central bore and into the external brush housing central bore;

F. a resilient spring sized to receive and correspond to the diameter of the guide element distal end comprises a resilient spring distal end attached to four equal sized detents spaced equally around a periphery of the straw funnel element proximal end;

G. a retainer collar element comprising a central opening diameter sized to correspond to the diameter of the guide element distal end, a distal side surface comprising three equal sized openings equally spaced about the retainer collar element central opening corresponding to the three threaded equal sized openings on the external brush housing element flanged surface, and four equal sized detents spaced equally around a periphery of the retainer collar central opening diameter, each detent fixedly attached to a resilient spring proximal end;

H. first equal sized threaded fasteners, each first equal sized fastener sized to be received through the two equal sized openings on the base element proximal end surface and threaded into the corresponding equal sized external brush housing element proximal end threaded openings securing the base element to the external brush housing element;

I. second equal sized threaded fasteners, each second equal sized threaded fastener sized to be received through one of the three equal sized threaded openings in the retainer collar element and threaded into a corresponding threaded equal sized opening on the external brush housing element flanged surface securing the guide element and the retainer collar element to the external brush housing element;

J. a flexible central brush comprising a threaded end sized to be received and held by the threaded opening centered on the base element distal end surface, a second end, and a length of bristles between the central brush threaded end and the central brush second end providing a length of flexible central brush element bristles extending through the six equal sized external brushes in the external brush housing element central bore and above and beyond the external brush housing element;

K. at least three base element radial arms disposed at equal angles one from the other orthogonal to the base element longitudinal axis, each base element radial arm comprising a first end affixed to a base element side, and a second end comprising a stabilizing disk, each stabilizing disk comprising a central opening;

L. a rubber suction cup sized to be received and held by each base element stabilizing disk central opening such that a suction cup concave portion is disposed face down under each stabilizing disk;

M. a rubber suction cup sized to be received and held by an aperture centered on the base element bottom side surface such that a suction cup concave portion is disposed face down under the base element.

8. The assembly of claim 7, wherein the external brush housing element further comprises:

A. an external brush housing element aperture orthogonally disposed to the longitudinal central axis and transecting the external brush housing element central bore near a midpoint between the external brush housing element proximal and distal surfaces and accessible from opposing sides of the external brush housing element; and B. an external brush housing element channel orthogonally disposed to the longitudinal central axis and transecting the external brush housing element central bore on the external brush housing element proximal surface and accessible from opposing sides of the external brush housing element, one end of the external brush housing element channel comprising a notch on the same side of the external brush housing element as the side comprising a notch on the base element.

9. The assembly of claim 8, wherein the base element distal end surface comprises detent alignment guides to center and orient the external brush housing element proximal end surface to facilitate alignment of the two respective elements.

* * * * *